United States Patent [19]

Aleksandrow

[11] 4,357,807

[45] Nov. 9, 1982

[54] LOW ENERGY ICE MAKING APPARATUS

[76] Inventor: Jerry Aleksandrow, 415 Crescent, Lombard, Ill. 60148

[21] Appl. No.: 223,569

[22] Filed: Jan. 9, 1981

[51] Int. Cl.[3] ..... F25C 1/12

[52] U.S. Cl. ..... 62/228; 62/233; 62/320; 62/352; 165/76; 29/157.4

[58] Field of Search ..... 62/320, 352, 506, 228 D, 62/348, 233, 228 A; 165/175, 76, 173; 29/157.4

[56] References Cited

U.S. PATENT DOCUMENTS

| | | | |
|---|---|---|---|
| 1,278,243 | 9/1918 | Sonneborn | 165/175 |
| 2,440,872 | 5/1948 | Pfeil | 62/320 X |
| 2,633,004 | 3/1953 | Leeson | 62/506 X |
| 2,747,375 | 5/1956 | Pichler | 62/320 X |
| 3,164,972 | 1/1965 | Swanson | 62/320 |
| 3,423,949 | 1/1969 | Leeson et al. | 62/320 X |
| 3,788,089 | 1/1974 | Graves | 62/340 X |
| 3,898,527 | 8/1975 | Cawley | 62/228 D X |
| 4,154,063 | 5/1979 | Aleksandrow | 62/138 |

*Primary Examiner*—William E. Tapolcai
*Attorney, Agent, or Firm*—Robert F. Van Epps

[57] ABSTRACT

A low energy ice making apparatus employing a low volume carnot cycle refrigeration system. Ice is progressively formed on a plurality of improved evaporator plates and harvested by a secondary condenser grid heated by the warm liquid refrigerant discharged by a primary water cooled condenser. The apparatus incorporates an improved water manifold and secondary condenser grid construction.

14 Claims, 8 Drawing Figures

LOW ENERGY ICE MAKING APPARATUS

BACKGROUND OF THE INVENTION

1. Field of the Invention

This invention relates generally to the field of ice making apparatus and more particularly to a new and improved apparatus for making ice slabs and thereafter dividing the same into cubes.

2. Brief Description of the Prior Art

Prior to the present invention it has been known to form slabs of ice on an inclined refrigerated plate assembly associated with a mechanically driven refrigerant compressor to cool the plate below freezing while water is circulated thereover. Once a slab of ice of preselected thickness is formed the plate is heated to release the slab onto a heated grid for separation into individual cubes which are collected in a storage bin. The most current prior art in this field is represented by U.S. Pat. No. 4,154,063 which issued on May 15, 1979, to the applicant herein.

Prior art commercial ice making machines employ a large volume of refrigerant (usually refrigerant no. 12) charge. This is done in order to provide a liquid/vapor state in the evaporator tubes. As heat is transferred from the water or ice through the plate to the evaporator tubes the refrigerant is boiled off into the vapor state. Since there is an excess of liquid refrigerant, not all of it is vaporized in the formation of the ice slab. Residual liquid refrigerant is thus free to re-enter the compressor. The refrigerant, being an excellent solvent, causes the compressor lubricating oil to foam and eventually washes the oil from the compressor bearings. Even compressors designed to operate with liquid refrigerants suffer from reduced operating life for this reason.

In using the fully charged or flooded evaporator type refrigeration systems, the volume of refrigerant to be compressed is unnecessarily high and requires an oversize (high energy consuming) compressor and a condenser having a capacity which must exceed the BTU output of the compressor. A further drawback is that the volume of water through the condenser to cool the refrigerant after compression is excessive.

Ice makers of the prior art typically have evaporator assemblies incorporating inclined plates formed of high thermal conductivity materials such as copper, brass or aluminum. With such an arrangement, as water is circulated over the plate, ice is formed in thin layers over the entire surface of the plate. Since ice acts as an insulator, the heat transfer from the water to the refrigerant is progressively reduced as the ice slab thickness increases. This increases the freezing cycle time and is one of the factors giving rise to the need for a high volume of liquid refrigerant discussed above. Prior ice making machines do not use insulated evaporator tubes due to the high thermal conductivity of the plate. Such evaporator assemblies are known as the "wet" type in that atmospheric water will condense and frost or ice will form on the evaporator tubes.

Prior art ice making apparatus effect the release of an ice slab from the evaporator plate by directing hot compressor gases through the evaporator tubes. This creates undue thermal stress in the evaporator structure, tends to crack the ice slab and introduces excessive heat into the evaporator which must be removed in the next freeze cycle.

It is further known in the prior art to divide the ice slab into cubes by discharging the slab from the evaporator plate onto a heated grid. Electric wire grids have been used, however, a grid of tubing through which warm liquid refrigerant from the primary condenser is directed is considered more efficient. The tubing used in the grid is of necessity small and thin for efficient cutting and is generally soldered in holes drilled in a manifold. This type of construction is rigid but subject to failure in that the grid is repeatedly impacted by the ice slabs and must support the weight of the ice slab during the cube cutting process.

The ice makers of the prior art typically use a water manifold at the upper edge of the inclined evaporator plate and having a plurality of water discharge nozzles. The water discharge nozzles are required in order to discharge water evenly across the surface of the evaporator plate. The nozzles are subject to becoming clogged with impurities in the water and must be periodically disassembled for cleaning.

OBJECTS AND SUMMARY OF THE INVENTION

From the preceding discussion it will be understood that among the various objectives of the present invention are included:

the provision of a new and improved low energy ice making apparatus;

the provision of apparatus of the above-described character using a low volume refrigeration system.

the provision of apparatus of the above-described character having an improved energy efficient evaporator;

the provision of apparatus of the above-described character having an improved energy efficient cube cutting grid; and the provision of apparatus of the above-described character having an improved water circulation system.

The foregoing as well as other objectives of the present invention are efficiently achieved by providing a low volume, low-velocity compressor to compress and direct a refrigerant to a primary water cooled condenser which cools the refrigerant to a warm liquid state. The refrigerant is then passed through a secondary condenser cube cutting grid where it is supercooled before being injected via a capillary into an evaporator coil which is in high thermally conductive contact with an inclined evaporator plate formed of a thermally semi-conductive material. Water is circulated over the surface of the evaporator plate to progressively form a slab of ice of preselected thickness. Completed slabs are released onto a flexible, tubular cube cutting grid by directing warm gases from the compressor through the evaporator coil. The cube cutting grid also operates as the secondary condenser during the freeze cycle when warm liquid refrigerant is passed from the primary condenser through the tubular grid. The slab of ice is cut into cubes while supercooling the refrigerant. The cubes are then collected and stored in a bin.

These and other objects, features and advantages of the present invention will become more apparent from the following detailed description taken in conjunction with the appended drawings.

DESCRIPTION OF PREFERRED EMBODIMENT

Figure 1:
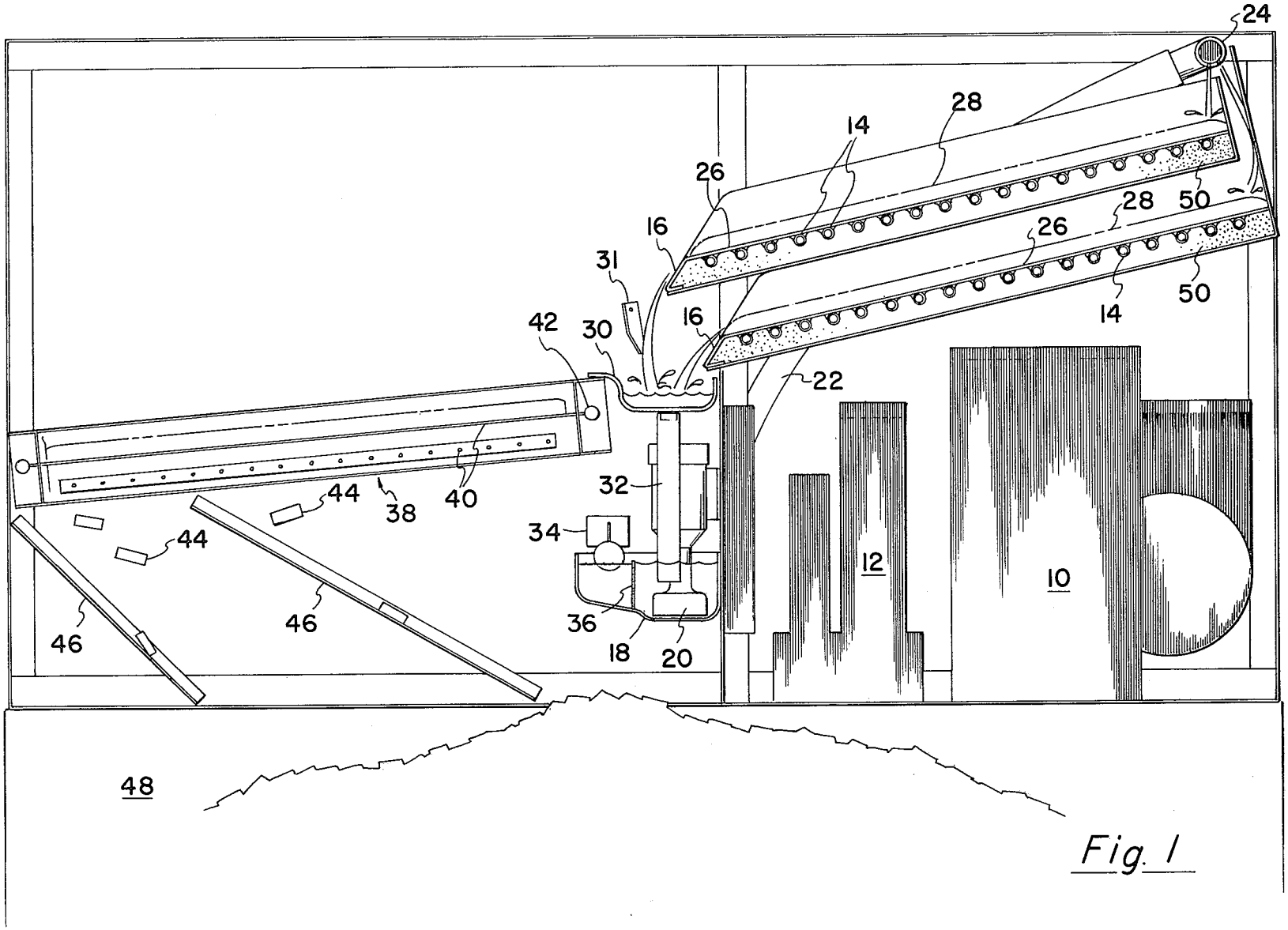
FIG. 1 is a partial vertical cross sectional view of an ice making apparatus in accordance with the present invention.

With reference now to FIG. 1 there is shown an ice making apparatus in accordance with the applicant's invention. A low volume, low velocity, high discharge pressure compressor 10 is used to compress refrigerant such as refirgerant no. 12 to a hot gaseous state. Representative of compressors useful in the practice of this invention is the model KAT20150CAB which is commercially available from Copeland Corporation of Sidney, Ohio. The compressed gas is then passed through a primary water cooled condenser 12 and a secondary condenser cube cutting grid to be hereinafter described and thence to the tubes 14 of the evaporators 16.

Water from a reservoir 18 is delivered by a pump 20 via hose 22 to a water manifold 24 where it is dispersed over the surfaces of the evaporators 16. As heat is transferred from the water through the evaporator plate 26 to the refrigerant a slab of ice 28 is formed. Excess water is collected in a trough 30 and returned to the reservoir 18 through return hose 32. A hinged splash curtain 31 prevents water from splashing into the cube storage bin. The reservoir is provided with a float valve 34 to control the water level and a baffle 36 to prevent wave action in the float compartment.

The production of slabs of ice 28 is accomplished on a timed basis. Typically, in approximately fifteen minutes a slab of $\frac{3}{8}''$ to $\frac{1}{2}''$ thickness is formed and ready for cube production. At the end of the freeze cycle a timer, to be more fully described hereinafter, terminates the flow of refrigerant through the evaporators 16 and directs warm gas from the compressor through a defrost valve into the evaporator tubes 14. The surfaces of evaporators 16 are thus gradually warmed, defrosting a thin layer of the ice slabs 28. The slabs then slide by gravity onto a secondary condenser cube cutting grid 38. As the ice slab 28 slides off the evaporator it trips a micro switch (not shown) which operates to close the defrost valve, reset the timer and start another freeze cycle.

The secondary condenser cube cutting grid 38 comprises first and second arrays of thin tubes 40 disposed one above and at a right angle to the other. Warm liquid refrigerant from the primary condenser 12 is passed through a manifold 42 to the tubes 40 such that the ice slab 28 is sliced into cubes 44 which are directed by chutes 46 into a storage bin 48. As the slab of ice 28 is cut into cubes 44 the compressed refrigerant is supercooled prior to being directed to the evaporators 16 thus recycling energy and providing improved efficiency.

The evaporators 16 are constructed of a thermally semi-conductive evaporator plate 26 to the under side of which is fixed highly thermally conductive evaporator tubing 14. The applicant has found that a chromium steel, and in particular 18 gauge stainless steel, is a useful material for the evaporator plate 26. The evaporator tubing 14 is preferrably copper, brass or aluminium bonded in positive heat transfer contact to the evaporator plate 26 as by silver solder. The tubes are then insulated from the environment with an insulation material 50. The insulation prevents the transfer of heat from the surrounding environment to the refrigerant before it is transferred from the water through the stainless steel thus permitting the use of a lower volume of refrigerant. It further prevents condensation and freezing of ambient moisture on the tubes.

Figure 2:
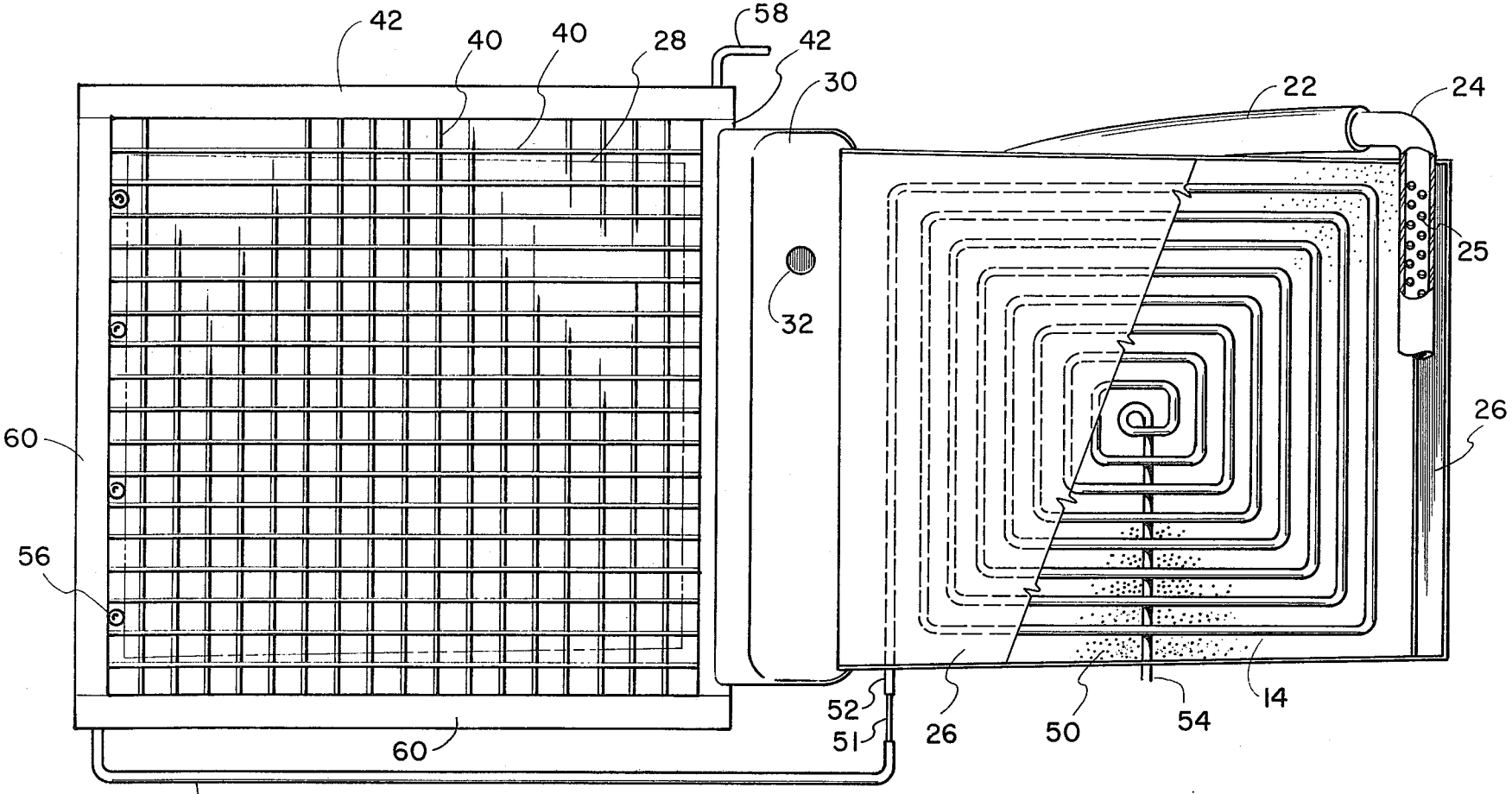
FIG. 2 is a top view partially cutaway of the evaporator and cube cutting grid of FIG. 1.

FIG. 2 is a top view, partially cut away, of the apparatus of FIG. 1 wherein like elements are identified by like reference characters. The water manifold 24 is of a simplified construction and comprises a thick walled (approximately $\frac{1}{8}$ inch) tube having a linear array of apertures 25 drilled therein at an angle of approximately twenty degrees to the water flow. With this arrangement the water is distributed evenly across the surface of the evaporator plate 26 without the need for any nozzles.

In the illustrated embodiment the evaporator tubing 14 is arranged in a spiral configuration having an inlet 52 at the outer edge and an outlet 54 from the center. Because the evaporator plate 26 is thermally semiconductive, as the refrigerant is injected via a capillary 51 into inlet 52 and vaporizes into evaporator tubing 14 and the water is delivered from manifold 24, ice tends to be formed in progressive stages from the outer edges toward the center of plate 26 rather than in thin layers over the entire evaporator surface. In this manner the heat transfer efficiency of the evaporator is substantially improved and less refrigerant is required. In turn a lower velocity compressor and a much smaller condenser may be used.

An ice slab 28 is released from the evaporator plate 26 and slides onto the secondary condenser cube cutting grid. A plurality of resilient bumpers 56 are provided at the lower end of the grid to absorb the shock and prevent the slab from breaking. The warm liquid refrigerant from the primary condenser is applied to the intake manifolds 42 via inlet 58 and pass through the tubes 40 to the exhaust manifolds 60 and on to the evaporator via outlet 62.

With the foregoing construction there exists a balance of the refrigeration system between the secondary condenser cube cutting grid and the evaporator thus providing a no-load system. Since the refrigerant is supercooled in the secondary condenser by the ice as it is being cut into cubes the pressure drops and the flow of refrigerant through the capillary into the evaporator is maximized. When the cube cutting is complete the evaporator has been filled with cold refrigerant vapor and the temperature of the refrigerant leaving the secondary condenser rises. The pressure thus increases and reduces the refrigerant flow through the capillary. While the use of a capillary is preferred it will be apparent that the balance may also be maintained through the use of a temperature sensor at the evaporator output to control an expansion valve at the inlet.

The use of supercooling of the refrigerant together with the progressive freezing evaporators ensures that substantially all of the refrigerant exiting the evaporators is in the vapor state. The effect is than the compressor need only operate at a fraction of its full capacity thus avoiding mechanical, thermal and electrical overloading and use of a lower volume of refrigerant is permitted. Further, a lower capacity primary water cooled condenser can be used. In actual practice the applicant has found that when using a 12,000 B.T.U. compressor in his no-load system only a 4,000 B.T.U. condenser is required for efficient operation.

Figure 3:
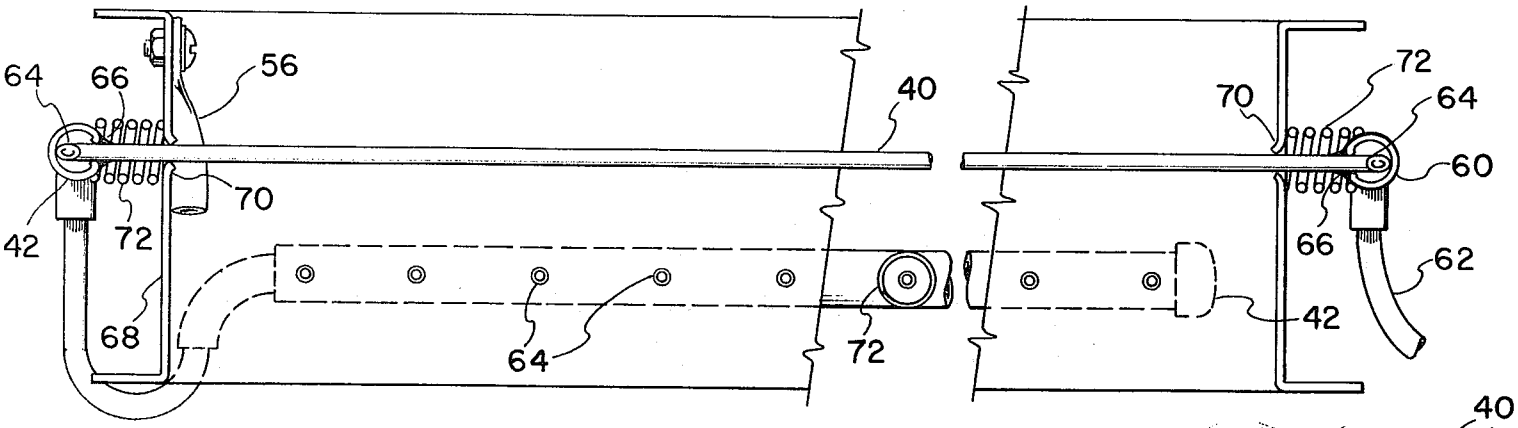
FIG. 3 is a vertical cross-sectional view of the cube cutting grid.

FIG. 3 is a more detailed cross section illustration of the secondary condenser cube cutting grid. The intake and exhaust manifolds 42 and 60 respectively each have a linear array of holes 64 punched therein into which the grid tubes 40 are inserted. The grid tubes 40 are preferably cut at approximately a 45° angle for most efficient gas flow and to prevent the tube from sealing itself to the manifold wall when inserted. The formation of the holes 64 by punching is preferred over drilling in that a larger surface area is provided to support the tube 40 and the surface indentation provides a larger pool area for solder 66 thus adding structural integrity to the grid.

The secondary condenser cube cutting grid is mounted in a frame 68 which also has a linear array of holes 70 punched therethrough to accomodate the grid tubes 40. Here again punched as opposed to drilled holes are preferred due to the increased support which is provided for the grid tubes 40. Since the grid tubes 40 are quite thin for efficient cutting of the ice slab into cubes but must also withstand the repeated impact of the ice slabs falling from the evaporator it is desirable to provide the grid with resiliency. This is accomplished by placing a spring 72 around each grid tube 40 between the manifolds 42 and 60 and the outer surface of the frame 68 which tends to relieve the stress on the solder joint between the grid tubes 40 and the manifolds 42 and 60.

In the practice of his invention the applicant has found that grid tubes 40 of stainless steel, brass, copper or monel provide the most efficient cutting.

Figure 4:
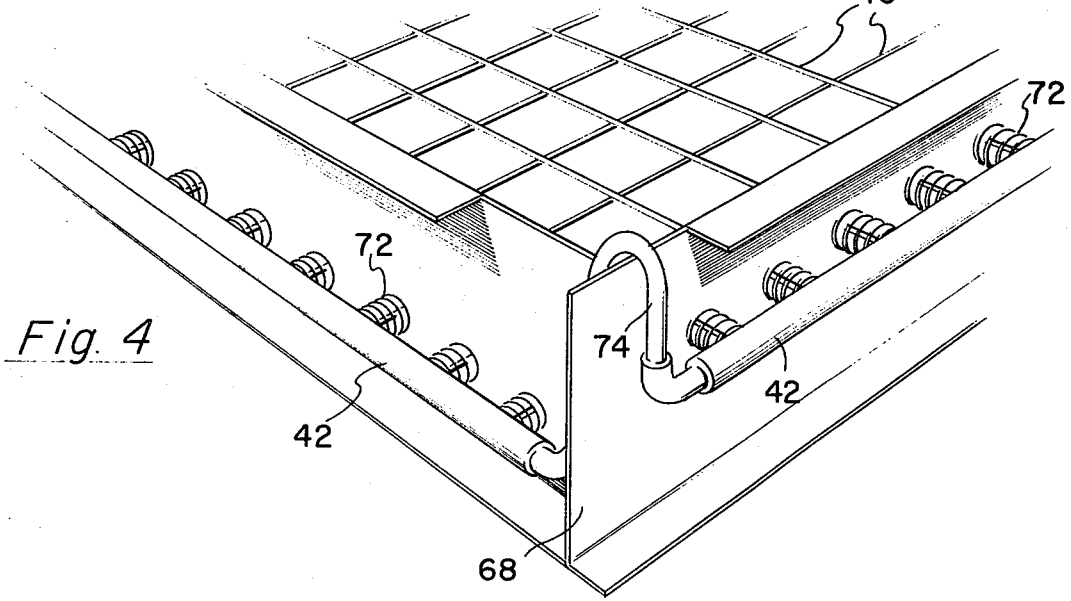
FIG. 4 is a partial elevation view of the cube cutting grid.

FIG. 4 is a partial elevation view of the secondary condenser cube cutting grid. Since the grid is flexibly mounted in the frame 68 it is desirable to provide a stress relief connection 74 between the manifolds 42. A similar arrangement is used between the manifolds 60 (not shown).

Figure 5:
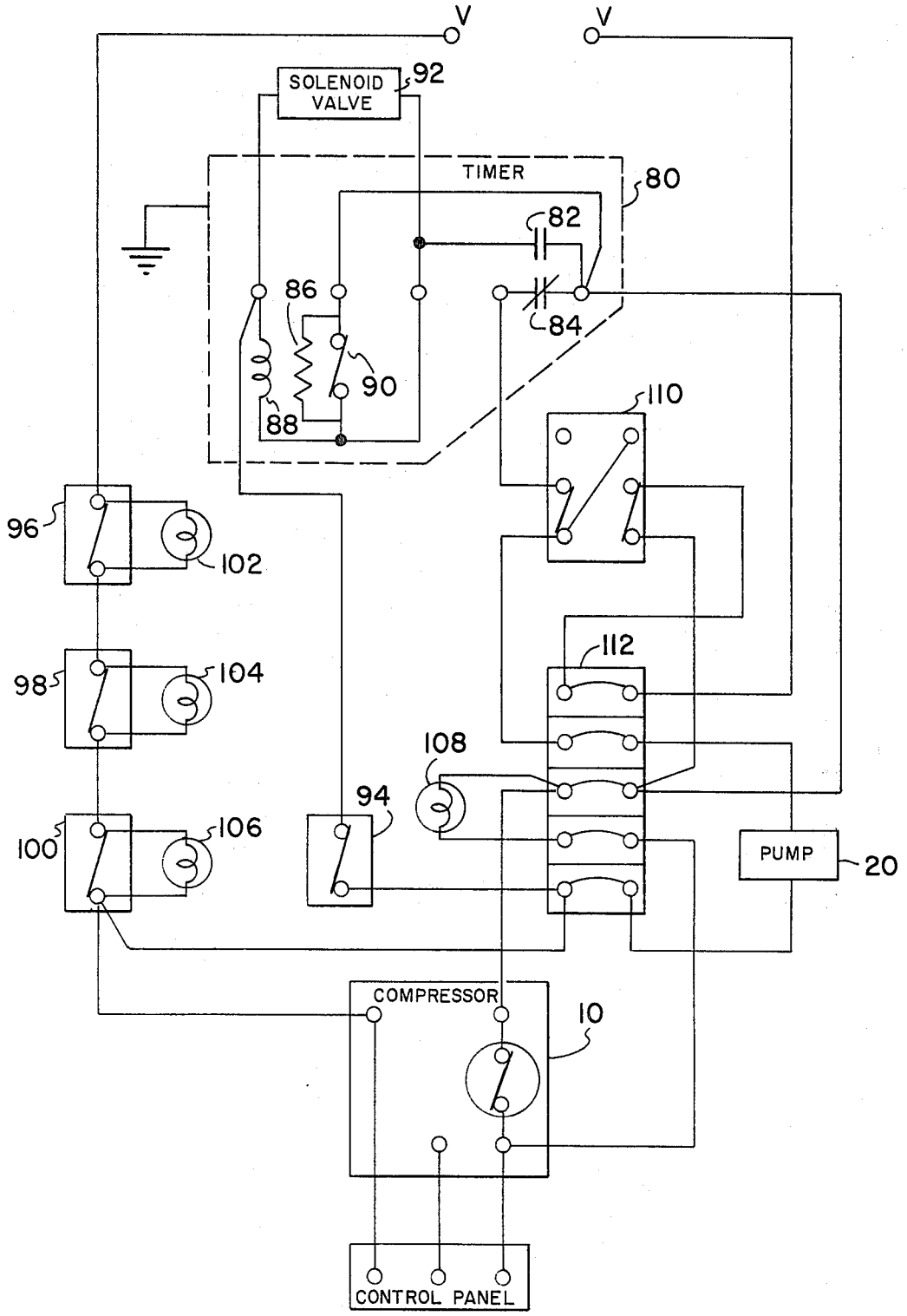
FIG. 5 is a schematic diagram of the electrical portion of the apparatus of FIG. 1.

FIG. 5 is a schematic diagram of the electrical portion of the apparatus of the invention and illustrates the electrical condition during the freeze cycle. "V" represents the primary power source for the apparatus and is generally 230 volt, single phase, 60 hertz. The freeze cycle is controlled by a timing circuit 80 comprising capacitor 82, variable capacitor 84, resistor 86 and inductance 88. During the freeze cycle a normally closed switch 90 remains closed and the solenoid valve 92 is unactivated such as to direct the warm compressed gas output of compressor 10 to the primary and secondary condensers. The water pump 20 is also activated to disperse water over the evaporator plates. At the end of the freeze cycle switch 90 opens thus energizing solenoid valve 92 to direct the warm compressor gas through the evaporator coils gradually warming the evaporator plate to release the ice slabs. The gradual warming of the evaporator plate has been found by the applicant to effect release of the ice slab at substantially lower temperatures than prior art machines. Since less heat must be removed from the evaporator during the next freeze cycle energy is conserved and the freeze cycle shortened. As the slab leaves the evaporator plate it trips a normally closed micro switch 94. The operation of switch 94 serves to close switch 90 in the timer which de-energizes solenoid valve 92 and returns the apparatus to the freeze cycle. During the defrost portion of the cycle the operation of pump 20 is interrupted.

A bin thermostat 96 is disposed in the cube storage bin such that when the bin is filled the contacts open and operation of the apparatus is terminated. A normally closed pressure sensitive switch 98 is used at the output of the compressor to terminate operation when the output pressure exceeds a predetermined value. Similarly a normally closed pressure sensitive switch 100 is used at the compressor intake to sense intake pressure below a predetermined value and terminate operation of the apparatus. Indicator lamps 102, 104 and 106 are associated with each of the thermostat 96, high pressure sensor 98 and low pressure sensor 100 respectively to indicate the cause for termination of operation. An additional indicator lamp 108 is used to monitor the operation of the compressor 10. A double pole double throw switch 110 permits independent operation of the pump 20, and numeral 112 represents a conventional terminal block for ease of making the electrical connections between the various components.

Figure 6:
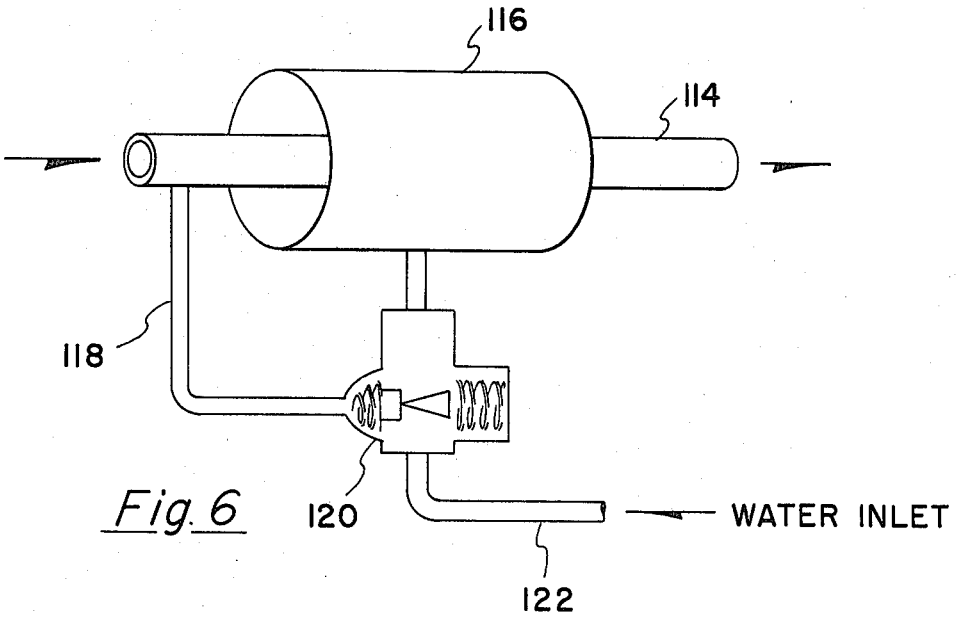
FIG. 6 is a partial cutaway view of the primary condenser water flow control feature of the invention.

FIG. 6 illustrates a further energy saving feature of the invention. A section of the primary water cooled condenser is shown and includes a refrigerant passage 114 disposed within the water jacket 116. A pressure sensing tube 118 is coupled to the primary condenser inlet (compressor outlet) and to a water regulating valve 120 in the water inlet 122. When the refrigerant is being supercooled by the ice slabs on the secondary condenser cube cutting grid as discussed above the compressor output temperature, and thus pressure, will be lower. The demand on the primary condenser is thus lower and the water regulating valve 120 is closed to conserve on water usage.

Figure 7A:
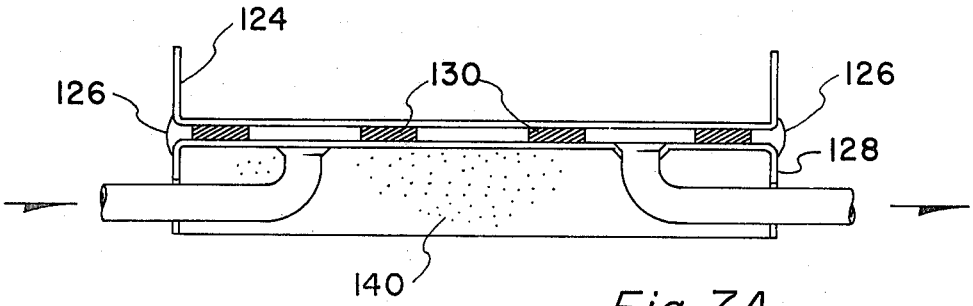
FIGS. 7A and 7B are vertical and horizontal cross section views respectively of an alternative evaporator useful in the practice of the invention.
Figure 7B:
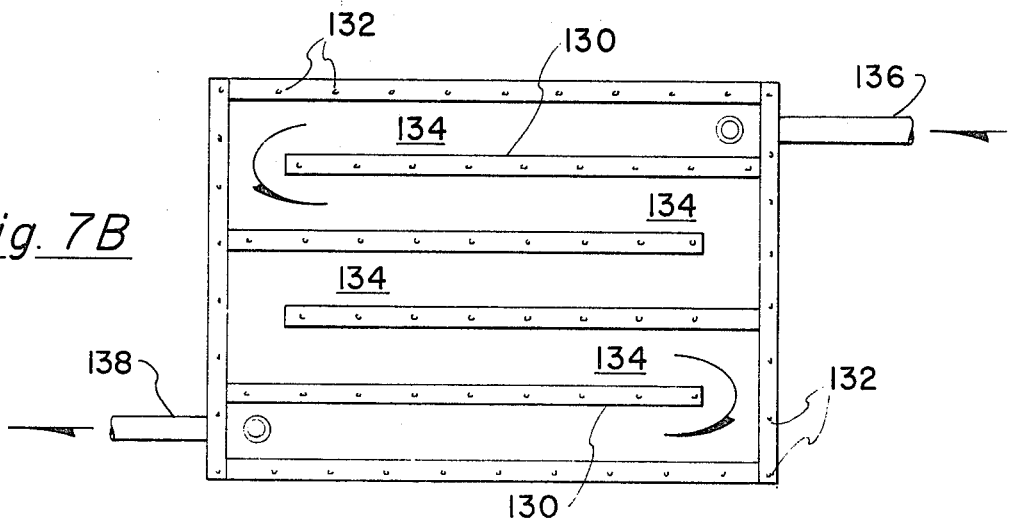

FIGS. 7A and 7B are vertical and horizontal cross section views repsectively of an alternative embodiment of an evaporator assembly useful in the practice of the applicant's invention. A first u-shaped pan 124 formed of a thermally semiconductive metal as described above is welded at its periphery 126 to a second metal pan 128. A plurality of thermally semiconductive metal spacers 130 are disposed between the first and second pans 124 and 128 and fixed in position as by spot welds 132 to define a refrigerant flow passage 134. Refrigerant injected at the evaporator inlet 136 traverses the passage 134 and exits via outlet 138. As with the previously described evaporator configuration this construction also provides the progressive ice formation and high heat transfer efficiency. The second pan is also filled with insulation material 140 as described above.

By using the combination of the improved secondary condenser to supercool the liquid refrigerant while cutting the slab ice into cubes together with the low volume, low speed compressor, improved evaporator construction and lower defrost temperatures the applicant has provided an energy efficient ice making apparatus having a minimum of moving parts. Since certain changes in the above described apparatus will occur to those skilled in the art without departure from the scope of the invention it is intended that all matter set forth in the foregoing description or shown in the appended drawings shall be interpreted as illustrative and not in a limiting sense.

Having described what is new and novel and desired to secure by Letters Patent, what is claimed is:

1. An ice making apparatus comprising an inclined evaporator on the upper surface of which a slab of ice may be formed, said evaporator surface being formed of a thermally semiconductive chromium steel material and having means for directing a refrigerant on a preselected path in thermal contact with the lower surface of said evaporator;

a low volume, low velocity compressor having an inlet and an outlet;

a primary condenser having an inlet and an outlet;

a secondary condenser cube cutting grid including first and second arrays of substantially parallel, spaced apart refrigerant conducting tubes, one disposed above the other at an angle thereto, each said array being coupled at one end to an intake manifold and at the other to an outlet manifold;

means for coupling said compressor outlet to the inlet of said primary condenser;

means for coupling said primary condenser outlet to said secondary condenser cube cuting grid inlet manifold;

means for coupling said secondary condenser cube cutting grid outlet manifold to a first end of said refrigerant path;

means for coupling the other end of said refrigerant path to the inlet of said compressor;

means for circulating water over the surface of said evaporator surface while a refrigerant is directed from said secondary condenser cube cutting grid through said evaporator whereby a slab of ice is progressively formed over the surface of said evaporator;

timing means for interrupting the circulation of water over the evaporator surface at preselected intervals of time;

means coupled to the outlet of said compressor and to said timing means for directing compressed refrigerant to said evaporator to thereby progressively warm said evaporator surface and release said slab of ice onto said secondary condenser cube cutting grid; whereby heat is transferred from said refrigerant conducting tubes of said cube cutting grid to said ice slab to thereby cut said ice slab into cubes;

means coupled to said timing means for sensing the release of said slab of ice and operative to reset said timing means; and means for collecting and storing said ice cubes.

2. Apparatus as recited in claim 1 wherein said evaporator comprises an evaporator plate;

an evaporator coil thermally connected to the lower surface of said evaporator plate; and means for insulating said evaporator coil from the environment.

3. Apparatus as recited in claim 1 wherein said evaporator comprises an evaporator plate;

an inverted metallic pan affixed at the periphery of the upper surface thereof to the lower surface of said evaporator plate;

a plurality of thermally semiconductive metal spacers disposed between said evaporator plate and said metallic pan for defining said preselected refrigerant path; and inlet means for injecting a refrigerant between said evaporator plate and said metallic pan at one end of said refrigerant path;

outlet means for coupling the opposite end of said refrigerant path to the inlet of said compressor; and insulation disposed in said metallic pan to insulate said refrigerant path from the environment.

4. Apparatus as recited in claim 1 wherein said primary condenser is a water cooled condenser having a water jacket disposed about a refrigerant line, said jacket having a water inlet and further including means for sensing the pressure of said refrigerant at said inlet of said primary condenser;

a water regulating valve disposed in said water inlet to said water jacket, said valve being coupled to said pressure sensing means and operating to reduce water flow through said condenser in response to a reduction of refrigerant pressure below a predetermined level.

5. Apparatus as recited in claim 1 wherein said means for coupling said secondary condenser cube cutting grid outlet manifold to said first end of said refrigerant path comprises a capillary tube.

6. Apparatus as recited in claim 1 wherein said secondary condenser cube cutting grid comprises a rectangular supporting framework having a linear array of holes punched therein adapted to slidably receive said first and second arrays of refrigerant conducting tubes;

first and second inlet manifolds each having a linear array of holes punched therein adapted to receive one end of each of said first and second arrays of refrigerant conducting tubes, said first and second inlet manifolds being coupled to one another and to said primary condenser;

first and second outlet manifolds each having a linear array of holes punched therein adapted to receive the opposite end of each of said first and second arrays of refrigerant conducting tubes, said first and second outlet manifolds being coupled to one another and to said evaporator; and means for securing each said refrigerant conducting tube in a respective punched hole in said inlet and outlet manifolds.

7. Apparatus as recited in claim 6 further including a spring disposed about each said refrigerant conducting tube between said manifolds and the outer surface of said supporting framework.

8. Apparatus as recited in claim 6 wherein the ends of said refrigerant conducting tubes are formed at an angle to their longitudinal axis.

9. Apparatus as recited in claim 6 further including cushioning means affixed to the inner surface of said supporting framework on the side opposite said evaporator in the plane of said upper array of refrigerant conducting tubes.

10. Apparatus as recited in claim 1 wherein said water circulating means includes a water manifold having a linear array of holes drilled therein at a predetermined angle toward the direction of water flow through said manifold.

11. Apparatus as recited in claim 10 wherein said angle is substantially twenty degrees.

12. Apparatus as recited in claim 1 further including pressure sensing means coupled to said compressor inlet and operative to interrupt operation of said compressor and said water circulating means when the pressure at said inlet is below a predetermined level.

13. Apparatus as recited in claim 1 further including pressure sensing means coupled to said compressor outlet and operative to interrupt operation of said compressor and said water circulating means when the pressure at said outlet is in excess of a predetermined level.

14. Apparatus as recited in claim 1 further including temperature sensing means disposed in said collecting and storing means for sensing when said storing means is filled with ice cubes and operative to interrupt operation of said compressor and said water circulating means.

* * * * *